US011542616B2

(12) United States Patent
Andersson

(10) Patent No.: US 11,542,616 B2
(45) Date of Patent: Jan. 3, 2023

(54) SILVER-GRAPHENE COMPOSITE COATING FOR SLIDING CONTACT AND ELECTROPLATING METHOD THEREOF

(71) Applicant: Hitachi Energy Switzerland AG, Baden (CH)

(72) Inventor: Anna Andersson, Västerås (SE)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 17/281,388

(22) PCT Filed: Oct. 9, 2019

(86) PCT No.: PCT/EP2019/077292
§ 371 (c)(1),
(2) Date: Mar. 30, 2021

(87) PCT Pub. No.: WO2020/074552
PCT Pub. Date: Apr. 16, 2020

(65) Prior Publication Data

US 2021/0310142 A1 Oct. 7, 2021

(30) Foreign Application Priority Data

Oct. 11, 2018 (EP) ..... 18199860

(51) Int. Cl.
*C25D 3/46* (2006.01)
*C25D 15/02* (2006.01)

(52) U.S. Cl.
CPC ..... *C25D 3/46* (2013.01); *C25D 15/02* (2013.01)

(58) Field of Classification Search
None
See application file for complete search history.

(56) References Cited

U.S. PATENT DOCUMENTS 7,393,473 B2 7/2008 Mlyazawa et al.
7,638,721 B2 12/2009 Rehbein et al.
(Continued)

FOREIGN PATENT DOCUMENTS

CH 622032 A5 3/1981
CN 86103364 A 3/1987
(Continued)

OTHER PUBLICATIONS

Diba et al Progress in Materials Science 82 (2016) 83-117) (Year: 201).*
(Continued)

*Primary Examiner* — Louis J Rufo
(74) *Attorney, Agent, or Firm* — Sage Patent Group

(57) ABSTRACT

The present disclosure relates to a method of electroplating of a silver-graphene composite onto a substrate. The method comprises preparing a plating bath comprising: a dissolved water soluble silver salt, dispersed graphene flakes, and an aqueous electrolyte comprising a silver complexing agent, a cationic surfactant, and a pH adjusting compound. The zeta potential of the graphene-electrolyte interface in the plating bath is adjusted to be positive and within the range of 10-30 mV by means of the cationic surfactant and the pH adjusting compound. The method also comprises applying a negative electric potential on the substrate surface such that electrophoresis of the graphene flakes occurs and said flakes are co-deposited with the silver during electroplating thereof to form a silver-graphene composite coating on the substrate surface.

18 Claims, 1 Drawing Sheet

(56) References Cited

U.S. PATENT DOCUMENTS

| | | | | |
|---|---|---|---|---|
| 9,217,205 | B2 | 12/2015 | Abys et al. | |
| 2014/0374267 | A1* | 12/2014 | Monteiro | C25D 15/00 205/104 |
| 2015/0279506 | A1* | 10/2015 | Wolfrum | C09C 1/44 252/510 |

FOREIGN PATENT DOCUMENTS

| | | | | |
|---|---|---|---|---|
| CN | 1904145 | A | 1/2007 | |
| CN | 101946029 | A | 1/2011 | |
| CN | 102061504 | A | 5/2011 | |
| CN | 103469261 | A | 12/2013 | |
| CN | 103590089 | A | 2/2014 | |
| CN | 103882499 | A | 6/2014 | |
| CN | 104342726 | A | 2/2015 | |
| CN | 104472542 | A | 4/2015 | |
| CN | 105040047 | A | 11/2015 | |
| CN | 105821465 | A | 8/2016 | |
| CN | 106367785 | A | 2/2017 | |
| CN | 106591898 | A | 4/2017 | |
| CN | 107217292 | A | 9/2017 | |
| CN | 107217292 | A * | 9/2017 | |
| CN | 107345307 | A | 11/2017 | |
| CN | 107574470 | A | 1/2018 | |
| EP | 1939331 | A1 | 7/2008 | |
| EP | 2634293 | A2 * | 9/2013 | C25D 3/30 |
| EP | 3388168 | A1 | 10/2018 | |
| EP | 3388168 | A1 * | 10/2018 | H01H 11/048 |
| GB | 1534429 | A | 12/1978 | |

OTHER PUBLICATIONS

Song et al Chem. Commun., 2012, 48, 2119-2121 (Year: 2012).*
And Kumar et al RSC Adv., 2015, 5, 25603 (Year: 2015).*
Transferable Graphene Oxide Films with Tunable Microstructures Saad A. Hasan, John L. Rigueur, Robert R. Harl, Alex J. Krejci, Isabel Gonzalo-Juan, Bridget R. Rogers, and James H. Dickerson ACS Nano 2010 4 (12), 7367-7372 DOI: 10.1021/nn102152x (Year: 2010).*

International Search Report and Written Opinion dated Dec. 10, 2019 for International Application No. PCT/EP2019/077292, 12 pages.
Mehmet Uysel et al.; "Structural and Sliding Wear Properties of Ag/Graphene/WC Hybrid Nanocomposites Produced by Electroless Co-Deposition"; Journal of Alloys and Compounds, vol. 654, Jan. 1, 2016; pp. 185-195 (11 pages).
Fang Mao et al.; "Graphene as a Lubricant on Ag for Electrical Contact Applications"; Journal of Materials Science, vol. 50, No. 19, Jul. 3, 2015; pp. 6518-6525 (8 pages).
Extended European Search Report dated Apr. 12, 2019 for European Patent Application No. 18199860.0, 6 pages.
Stappers et al.; "Electrodiposition of Silver-Carbon Coatings with Low Contact Resistance and Wear Rate"; Journal of The Electrochemical Society, vol. 160, No. 4, Feb. 2, 2013, pp. D137-D145 (9 pages).
Huang et al.; "Preparation and Characterization of the Graphene-Cu Composite Film by Electrodeposition Process"; Microelectronic Engineering, vol. 157, Feb. 6, 2016, pp. 7-12 (6 pages).
Mai et al.; "Surfactant-Free Electrodeposition of Reduced Graphene Oxide/Copper Composite Coatings with Enhanced Wear Resistance"; Applied Surface Science, vol. 433, Oct. 4, 2017, pp. 232-239 (8 pages).
Michelsen-Mohammadein, "Dispersionsschichten Für Elektrische Kontakte"; Galvanotechnik; vol. 87, No. 6, 1996, 9 pages.
Siemens AG; "Sicat 8WL6134 for Overhead Contact Line Systems"; Industry Sector, Mobility Division, Complete Transportation, 2010, 8 pages.
Chinese First Office Action dated Jun. 29, 2021 for Chinese Patent Application No. 201980066653.0, 14 pages (including English translation).
Xu Qiangling, "New Technology of Modern Surface Treatment," Shanghai Scientific and Technological Literature Press, May 31, 1994, pp. 610-614. Statement of Relevance: Cited pages discuss electroplating techniques, including the definition of electrophoresis velocity, where V is electrophoresis velocity, D is dielectric constant of solvent, E is streaming potential, Z is Zeta potential, and u is viscosity coefficient of solvent.
Stenius, Per, "Forest Products Chemistry," China Light Industry Press, Sep. 30, 1997, pp. 164-165. Statement of Relevance: Cited pages discuss papermaking science and technology, including the definition of zeta potential as being changed based on the pH.

* cited by examiner

SILVER-GRAPHENE COMPOSITE COATING FOR SLIDING CONTACT AND ELECTROPLATING METHOD THEREOF

CROSS-REFERENCE TO RELATED APPLICATIONS

This application is a 35 U.S.C. § 371 national stage application of PCT International Application No. PCT/EP2019/077292, filed on Oct. 9, 2019, which in turns claims foreign priority to European Patent Application No. 18199860.0, filed on Oct. 11, 2018, the disclosures and content of which are incorporated by reference herein in their entirety.

TECHNICAL FIELD

The present disclosure relates to a method of electroplating of a silver-graphene composite onto a substrate.

BACKGROUND

Silver (Ag)-based contact materials are commonly used in various electrical power switching devices, where low losses and stable contact performance over life are of key importance. Ag is used as base material in both arcing and sliding contact systems, owing to its electrical properties. However, the mechanical and tribological properties of Ag are not impressive. It is soft and prone to cladding onto counter surfaces. For sliding contacts this usually means high wear rate and high friction.

When Ag is used in sliding contact configurations vs a copper (Cu) or Ag counter surface, a substantial amount of silver must be added to the contact to account for wear losses. The cladding of Ag onto a counter surface creates, in essence, an Ag—Ag contact. The coefficient of friction (COF) of such a contact in a lubricant-free environment is as high as 1.5 or higher. In a mechanical system, this friction needs to be overcome by the mechanical drive system of the device, which, in turn, costs drive energy and size in terms of the mechanical system dimensioning.

Nevertheless, Ag is still used in many applications, e.g. in on-load tap changers (OLTC's) and various breakers and switches, owing to its electrical properties.

One common method to decrease friction in Ag-based contacts is to apply a lubricating contact grease. However, with high switching demands, such as several hundreds of thousands or even millions of operations during the device lifetime, a grease is not a sustainable solution without regular additions of more grease. In addition, thermal load on the device may lead to grease evaporation, oxidation or decomposition, which can cause increased resistance and unstable contact properties. In applications like OLTC's, where switching components are submerged in electrically insulating transformer oil, which is poorly lubricating, application of a liquid lubricant oil or grease is not even possible.

Apart from lubricating oils and greases, there have been reports on alternative routes to improve tribological performance of Ag-based contacts. Adding graphite (at a concentration of a few percent by weight, wt %) to metallic silver gives a reduction of the COF down to ca. 0.3 vs. Ag or Cu counter surface. The hardness and density of such a composite is however limited owing to a low adhesion of the graphite particle surface to the Ag-matrix. This gives a high wear rate and substantial particle generation of Ag-graphite components. In addition, a thick carbon-based tribofilm builds up on wear which causes contact resistance to increase with time. The resistance-increase also applies when adding other friction- and wear-reducing additives into the Ag matrix e.g. $MoS_2$ or $WS_2$.

So called 'hard silver' (e.g. Argalux®64), an Ag alloy containing Ag, Cu and a small amount of antimony (Sb) is used in some commercial applications. Sb increases hardness significantly for this alloy, conductivity is fairly good, but COF is still in the region of 0.3-0.4 vs. Cu.

U.S. Pat. No. 6,565,983 discloses the use of silver iodide (AgI) as a dry lubricant top coat on Ag contacts in tap changers and to avoid the need for grease. AgI is however prone to decomposition in sunlight and at elevated temperature.

Graphene (G) and graphene oxide (GO) is known to have lubricating effects as a top coat in metal-to-metal contacts [F. Mao et al., J. Mater. Sci., 2015, 50, 6518; and D. Berman et al., Materials Today, 2014, 17(1), 31]. There are also studies of graphene having a lubricating effect in structural composites of aluminium (Al) [M. Tabandeh-Khorshid et al., J. Engineering Sci. and Techn., 2016, 19, 463]. Friction coefficients down to circa 0.2 in dry metal-to-metal contacts have been reported in literature.

Uysal et al., "Structural and sliding wear properties of Ag/Graphene/WC hybrid nanocomposites produced by electroless co-deposition", Journal of Alloys and Compounds 654 (2016), pages 185-195, discloses an electroless co-deposition technique for obtaining an Ag-graphene nanocomposite.

SUMMARY

It is an objective of the present invention to provide an improved silver-graphene composite coating by means of a novel electroplating method. The coating may advantageously be used for reducing friction and wear in sliding electrical contacts.

According to an aspect of the present invention, there is provided a method of electroplating of a silver-graphene composite onto a substrate. The method comprises preparing a plating bath comprising: a dissolved water soluble silver salt, dispersed graphene flakes, and an aqueous electrolyte comprising a silver complexing agent, a cationic surfactant, and a pH adjusting compound. The zeta potential of the graphene-electrolyte interface in the plating bath is adjusted to be positive and within the range of 10-30 mV by means of the cationic surfactant and the pH adjusting compound. The method also comprises applying a negative electric potential on a surface of the substrate such that electrophoresis of the graphene flakes occurs and said flakes are co-deposited with the silver during electroplating thereof to form a silver-graphene composite coating on the substrate surface.

According to another aspect of the present invention, there is provided a silver-graphene composite coating on a substrate surface. The composite coating comprises graphene in the form of graphene flakes having an average longest axis within the range of from 100 nm to 50 μm. The composite coating has a graphene content within the range of 0.05-1% by weight of the composite. The graphene flakes are aligned parallel to the substrate surface.

According to another aspect of the present invention, there is provided a sliding contact of an electric power device, the sliding contact comprising an embodiment of the composite coating of the present disclosure.

According to another aspect of the present invention, there is provided an electric power device, e.g. a high-voltage breaker or a generator circuit breaker, wherein the electric power device comprises an embodiment of the sliding contact of the present disclosure.

By means of the electrolyte, the zeta potential can be set such that the graphene flakes are co-deposited in in a controlled manner aligned with the substrate surface to give a composite in which the graphene flakes are well dispersed in the silver matrix and substantially flat and aligned with the substrate surface. An electrical field across the electrolyte bath is obtained by applying negative potential on the substrate. The dispersion is preferably stable until the electrical field is applied, after which the graphene flakes are moving electrophoretically towards the substrate surface together with the silver ions. The Ag ions are deposited (nucleation+coating growth) onto the substrate and the graphene sheets are simultaneously adsorbed and incorporated in the coating. The graphene adsorption and incorporation is achieved by means of the suitable zeta potential between the sheets and electrolyte.

The zeta potential is the potential difference between the electrolyte (dispersion medium) and the stationary layer of fluid attached to the graphene flakes (dispersed particle), and is thus a measure of the surface tension of the graphene-electrolyte interface.

A too high zeta potential favours the dispersed graphene flakes in the electrolyte and, although the graphene sheets may diffuse towards the substrate surface under the influence of the electric field, the incorporation of the flakes within the coating will not be favoured, and they may remain in the bath.

With a too low zeta potential, the graphene flakes may aggregate and thus not result in the flakes being well dispersed in the silver matrix of the composite or simply aggregate as particles on the beaker floor.

The desired zeta potential is obtained by means of the cationic surfactant at a specific pH which is set with the pH adjusting compound. In accordance with the present invention, the zeta potential should be positive and within the range of 10-30 mV. At this state, ultrasonication may be used to hinder dissolved graphene to agglomerate.

The silver complexing agent is used to stabilize the silver ions in the solution, hence to prevent the dissolved silver ions from transforming to metallic silver before the negative potential is applied to the substrate surface.

It is to be noted that any feature of any of the aspects may be applied to any other aspect, wherever appropriate. Likewise, any advantage of any of the aspects may apply to any of the other aspects. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

Embodiments will be described, by way of example, with reference to the accompanying drawings, in which.

DETAILED DESCRIPTION

Figure 1A:
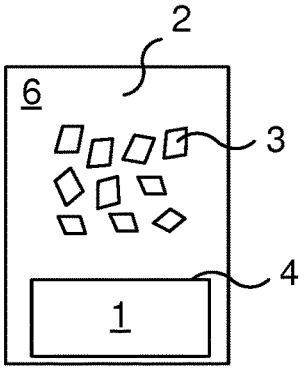
FIG. 1*a* is a schematic sectional illustration of a substrate submerged in a plating bath before an electrical field is applied, in accordance with embodiments of the present invention.

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

Embodiments of the present disclosure provides a self-lubricating electrical contact film, containing Ag and a small amount of graphene, that has low friction and high wear-resistance and enables grease-free operation in a sliding contact system, as well as a method of providing such a film which is herein called a silver-graphene composite coating.

Embodiments of the invention relates to a self-lubricating contact coating to be used as replacement for greased-lubricated Ag plated sliding contacts in power switching and interruption devices. The lubricating effect is stemming from a small amount of graphene flakes embedded in the Ag matrix, where the graphene flakes are aligned parallel to the substrate surface and distributed in such a way that a thin layer (e.g. in the range a few monolayers of graphene sheets) is formed on the contact surface during sliding. The sliding against a counter surface (e.g. Cu or Ag or same Ag-graphene coating) promotes a continuous removal of graphene sheets, but the small amount of graphene incorporated within the composite layer is continuously supplied to the surface since the flakes are dispersed throughout the whole thickness of the coating, maintaining an efficient tribological film on the coating throughout the lifetime of the sliding contact. The graphene also promotes a dispersion hardening of the composite coating, which reduces the wear rate.

Grease-lubricated electroplated Ag coatings (5-20 μm thick) in electrical sliding contacts exist in numerous devices today. Such contacts may beneficially be substituted for ones with the silver-graphene composite of the present disclosure. Examples of such contact-containing devices include: low voltage (LV) breakers and disconnectors, various plug-in sockets, rack-mounted cabinets, medium voltage (MV) breaking switches and disconnectors (e.g. gas/air), MV and high voltage (HV) gas-insulated switchgear (GIS), HV breakers and gas circuit breakers (GCB) etc. As there is a demand for higher ratings, increased number of operations, decreased losses and less service intervals, grease-lubricated systems become difficult to use. A specific example is for HV breakers and GCB's where the temperature rise requirement for Ag-plated nominal contacts is currently max 105° C. during operation, but the standard will soon change the limit to 115° C. (e.g. implying a need to withstand 10% higher currents). Today's contacts may not manage this due to grease degradation/evaporation, and they may become unstable and contact resistance may increase with time. To qualify a new grease in e.g. a sulfur hexafluoride ($SF_6$) environment may be costly and challenging. There are several other product examples like this where grease is becoming an issue, and consequently there is a need for new and more robust, preferably dry, contact system, as in accordance with the present disclosure.

Today, there are only few commercial alternatives to grease. One reason is the general compromise between good electrical and good tribological (low friction and wear) properties, often counteracting each other. For instance, AgI is one example of a dry lubricant top coat used on Ag contacts. Silver iodide (AgI) is however prone to decomposition in sunlight and at elevated temperatures (e.g. above 100° C.). Plated Ag-graphite films are also available but with other characteristics than the Ag-graphene composite proposed herein.

According to some embodiments of the present disclosure, a proposed solution is based on a thin coating of Ag mixed with aligned layers of graphene (i.e. single or few layers of hexagonal carbon) distributed throughout the coating. The microstructure and alignment, which may be important to the functionality of the coating, may be accomplished via an electrochemical co-deposition process as proposed herein.

It is known that graphene (G) sheets slide against each other with low friction due to very weak Van der Waals interactions between the pi-orbitals perpendicular to the sheet plane. In addition, carbon and silver do not form strong bonds with each other. Therefore, adding G to an Ag matrix introduces a friction-reducing component that, when the surface rubs against another surface, G gathers on the surface and promotes low friction as the graphene sheets slide on top of each other and on top of the Ag metal. A beneficial microstructure to minimize friction and to enable easy supply of new G sheets to the coating surface as G (eventually) wears off, is when the G sheets are:

1. Completely dispersed and separated in the Ag-matrix.
2. Completely flat with no wrinkles or folds.
3. Completely aligned (parallel) with the contact surface.

By applying a carefully designed electroplating process as proposed herein, it may be possible to achieve a composite coating such as listed above, or at least close enough to have properties, e.g. tribological properties and wear resistance, superior to the current state of the art. This coating, in the thickness range 1-20 μm, may be regarded as having self-lubricating properties, typically with friction coefficient values of at most 0.2 when sliding against a dry Cu or Ag counter contact surface. This can be compared a pure Ag contact sliding against another Ag or Cu surface, which gives a friction coefficient of >1. In addition, G flakes, e.g. nanoflakes, induce hardening of the Ag which substantially increases wear resistance. Also, the amount G needed for the improved properties is small (0.5 wt % graphene or less in the coating), and the graphene film formed on the coating surface is thin, which makes it possible to maintain the electrical properties of the Ag which is the main constituent of the coating. For these reasons, such a plating can readily be used as replacement for greased Ag plating as a sliding contact material in a wide range of power switching products, e.g. those mentioned above.

Thus, embodiments of the invention relate to a self-lubricating contact coating to be used as replacement for grease-lubricated Ag plated sliding contacts in power switching and interruption devices. The improved lubricating effect is stemming from the small amount of graphene flakes embedded in the Ag matrix, where the graphene flakes may preferably be aligned parallel to the substrate surface and distributed in such a way that a thin layer (e.g. in the range a few monolayers of carbon sheets) may be formed on the composite surface during sliding. The graphene dispersion and alignment may be accomplished via an electroplating route, in which an electrolyte, preferably aqueous, may in some embodiments be designed in such a way that:

1) An Ag salt is easily dissolved.

2) Graphene is dissolved but in a meta-stable state, such that the zeta (ζ)-potential between sheets and electrolyte is positive and between 10 and 40 mV, and such that electrophoresis of the graphene flakes occurs when an electric negative potential is applied on the substrate surface.

The above may be achieved by selecting the electrolyte solvent and Ag-salt as well as attaching a suitable surfactant/metal (e.g. $Ag^+$) ion onto the graphene flakes giving it a slight positive charge. The graphene flux towards the surface can be adjusted by means of the pH (and hence the zeta-potential) of the solution. Ultrasonication may in some embodiments be used to maintain separation of the graphene flakes in the electrolyte. Nucleation of Ag around the flakes is promoted by the attached surfactant/metal ion on the graphene and by the use of sub-micron lateral size of the flakes.

FIG. 1*a* is a schematic sectional illustration of a substrate 1, e.g. of copper, submerged in a plating bath 6 before an electrical field is applied. In the plating bath, the graphene flakes 3 are dispersed substantially evenly, preferably forming a stable dispersion. It can be noted that the flakes are not aligned at this stage, but have random orientations. A cationic surfactant, in combination with the pH set in bath 6 by means of a pH adjusting compound, provides a suitable zeta potential of the graphene-electrolyte interface to prevent the flakes from aggregating while at the same time facilitating electrophoresis when an electrical field is provided in the bath. The bath 6 also comprises dissolved silver ions ($A^g$+) which are prevented from spontaneously depositing on the substrate surface 4 before the electrical field is applied by means of a silver complexing agent. A solution of Ag ions without a silver complexing agent could potentially reduce spontaneously to Ag (electroless plating), but this is undesirable since then the graphene flakes will not move together with the Ag ions towards the substrate surface when the electrical field is applied.

The electrolyte 2 is preferably water-based, since an electroplating process in ethanol is currently not industrially feasible.

The zeta potential of the graphene-electrolyte interface in the plating bath is adjusted to be positive and within the range of 10 to 40 or 30 mV by means of the cationic surfactant and by setting the pH of the plating bath with the pH adjusting compound. In some embodiments, the zeta potential is adjusted to within the range of 15-25 mV, preferably 18-22 mV or 19-21 mV, such as to 20 mV.

In some embodiments of the present invention, the pH adjusting compound is or comprises potassium hydroxide (KOH) and/or sodium hydroxide (NaOH). In some embodiments KOH may be preferred, but it should be noted that any suitable pH adjusting compound may be used.

In some embodiments of the present invention, the cationic surfactant is or comprises cetyltrimethylammonium bromide (CTAB), dodecyltrimethyl-ammonium bromide (DTAB), tetrabutylammonium bromide (TBAB), and/or octyltrimetylammonium bromide (OTAB). In some embodiments CTAB may be preferred, but it should be noted that any suitable cationic surfactant may be used. Additionally or alternatively, the surfactant polyethyleneimine (PEI) may be used.

For instance, if the cationic surfactant is CTAB, the pH of the plating bath 6 may be set to within the range of 10-13, preferably 11-12, by means of the pH adjusting compound in order to obtain the desired zeta potential. In contrast, if PEI is used, the pH of the plating bath 6 may be set to within the range of 6-9, preferably 7-8, by means of the pH adjusting compound in order to obtain the desired zeta potential.

In some embodiments of the present invention, the surfactant may be present in the plating bath 6 in a concentration within the range of 0.5-2 mmol/L, e.g. within the range of 0.8-1.5 mmol/L or 0.8-1.2 mmol/L, such as 0.9-1.1 mmol/L, in order to obtain the desired zeta potential.

In some embodiments of the present invention, the silver salt is or comprises silver nitrate ($AgNO_3$) and/or silver oxide ($Ag_2O$). $AgNO_3$ may be preferred in some embodiments, but any suitable water-soluble silver salt may be used.

In some embodiments of the present invention, the silver salt is present in the plating bath 6 in a concentration within the range of 0.1-0.5 mol/L, e.g. within the range of 0.2-0.4 mol/L, such as 0.3 mol/L, which are suitable concentrations for achieving the electroplating and obtaining the coat 5.

In some embodiments of the present invention, the silver complexing agent is or comprises 5,5-dimethylhydantion, thiosulfate, ammonia, and/or thiourea. In some embodiments 5,5-dimethylhydantion may be preferred, but any suitable silver complexing agent may be used.

In some embodiments of the present invention, the silver complexing agent is present in the plating bath 6 in a concentration within the range of 0.5-2 mol/L, e.g. within the range of 1-1.5 mol/L or 1.1-1.3 mol/L, such as 1.2 mol/L, which may be suitable concentrations for stabilizing the Ag ions in the bath before the electrical field is applied.

In some embodiments of the present invention, the silver-graphene composite 5 has a graphene content within the range of 0.05-1% by weight of the composite, e.g. within the range of 0.2-0.5% or 0.2-0.4% by weight of the composite. These are regarded as suitable graphene concentrations for providing the improved tribological and wear properties while still not substantially altering the electrical properties compared with a pure silver coating.

In some embodiments of the present invention, wherein the coating 5 has a thickness within the range of 1-20 μm, e.g. within the range of 5-15 μm, such as 10 μm. These thicknesses may generally be suitable for a sliding contact, considering the number of sliding repetitions during a lifetime of a contact weighed against the material and production cost of the coating.

In some embodiments of the present invention, wherein the graphene flakes (3) have an average longest axis within the range of from 100 nm to 50 μm, e.g. within the range of 300 nm to 20 or 10 μm, preferably within the range of 500 nm to 1 μm.

In some embodiments of the present invention, the graphene flakes 3 have up to 150 graphene layers, e.g. up to 100 layers or up to 50 layers, preferably at most 10 layers such as 1-5 layers. For instance, graphene nanoplatelets of 11-150 graphene sheets may be used. The flakes are preferably thin enough to not substantially alter the electrical properties of the coating compared to pure silver coatings, but preferably contains at least two graphene sheets (i.e. monolayers) which can slide relative to each other with low friction.

Figure 1B:
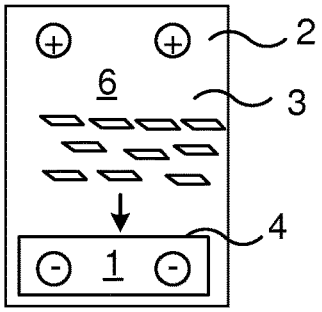
FIG. 1*b* is a schematic sectional illustration of a substrate submerged in a plating bath while an electrical field is applied, whereby graphene flakes are aligned and travelling towards the substrate surface, in accordance with embodiments of the present invention.

FIG. 1*b* is a schematic sectional illustration of the substrate 1 submerged in the plating bath 6 while an electrical field is applied, whereby graphene flakes 3 are aligned and travelling towards the substrate surface 4. By applying the electrical field, a negative potential is applied to the surface 4 of the substrate 1, as illustrated by the "-" signs in the figure. The flakes 3 aligns such that the planes of the respective flakes are substantially parallel with the plane of the surface 4, and the flakes move by electrophoresis towards the surface 4 with a speed which corresponds with the speed with which the Ag ions are transformed to silver on the surface by electroplating, thus co-depositing the graphene with the silver to form the composite coating 5 with graphene flakes dispersed throughout the thickness of the coating.

Figure 1C:
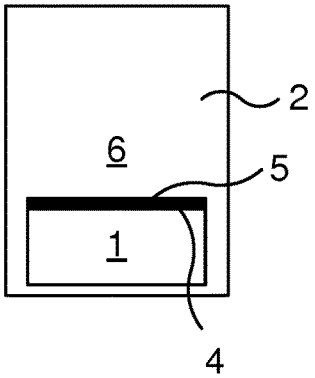
FIG. 1*c* is a schematic sectional illustration of a substrate submerged in a plating bath after an electrical field has been applied, whereby a silver-graphene composite coating has been formed on the substrate surface, in accordance with embodiments of the present invention.

FIG. 1*c* is a schematic sectional illustration of the substrate 3 submerged in the plating bath after the electrical field has been applied, whereby the silver-graphene composite coating 5 has been formed on the substrate surface 4.

Figure 2:
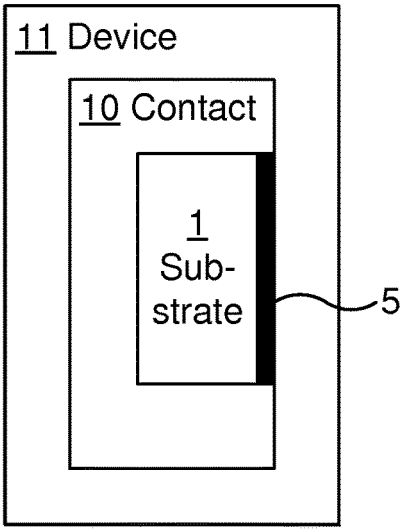
FIG. 2 is a schematic block diagram of an electrical power device comprising a sliding electrical contact, in accordance with embodiments of the present invention.

FIG. 2 is a schematic block diagram of an electrical power device 11 comprising a sliding electrical contact 10 in which the substrate 1 with the composite coating 5 is comprised. The contact 10 may be any type of sliding contact used in electrical applications and which is desired to be operated grease-free, e.g. in circuit breakers or any other switch for LV, MV or HV applications, typically in applications where silver plated sliding contacts are already used. The device 11 may similarly be any device in such applications, e.g. LV breakers and disconnectors, various plug-in sockets, rack-mounted cabinets, MV breaking switches and disconnectors (e.g. gas/air), MV and HV GIS, HV breakers and GCB etc., preferably, in some embodiments, nominal contact system in HV breakers, generator circuit breakers, interrupters or disconnecting circuit breakers (DCB). Specifically, the device may be an OLTC, since grease may not be used when the OLTC operates in an oil-filled environment.

The electrical contact 10 is herein described as a sliding contact, which is often preferred, e.g. for an interrupter, but also other types of electrical contacts may benefit from comprising the composite coating 5. For instance, the electrical contact 10 may be a knife contact (also called a knife switch), e.g. an earthing knife contact, for instance comprised in a DCB. However, in other DCB embodiments, the contact 10 may be a sliding contact.

Figure 3:
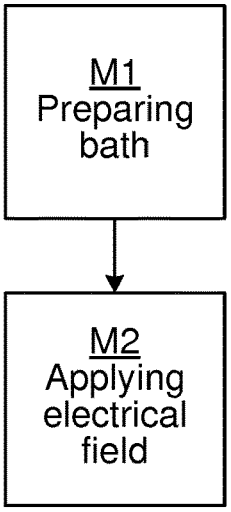
FIG. 3 is a schematic flow chart of an embodiment of the method of the present invention.

FIG. 3 is a schematic flow chart of an embodiment of the method of the present invention. In a first step, the plating bath 6 is prepared M1. As mentioned above, the plating bath comprises a dissolved water soluble silver salt, dispersed graphene flakes 3, and an aqueous electrolyte 2. The electrolyte 2 comprises a silver complexing agent, a cationic surfactant, and a pH adjusting compound. The zeta potential of the graphene-electrolyte interface in the plating bath is adjusted to be positive and within the range of 10-30 mV by means of the cationic surfactant and the pH adjusting compound. In a second step, a negative electric potential is applied M2 on a surface 4 of the substrate such that electrophoresis of the graphene flakes occurs and said flakes are co-deposited with the silver during electroplating thereof to form a silver-graphene composite coating 5 on the substrate surface. The negative electric potential may be applied by applying an electric field across the plating bath 6 such that the substrate surface 4 obtains a negative potential. The electric field may be obtained e.g. by applying a constant Direct Current (DC) or a constant DC potential or by using a periodic or pulsed source.

EXAMPLE

By applying a designed electroplating process, one can achieve an Ag-graphene composite coating 5 with the following properties:

1. A small amount (0.05-0.5 wt %) G flakes 3 are dispersed and separated in the Ag matrix.
2. The G flakes are flat with substantially no wrinkles or folds within the Ag matrix.
3. The G flakes within the Ag matrix are aligned (preferably parallel) with the contact surface 4.

This coating 5, in the thickness range of 1-20 μm, has self-lubricating properties with a friction coefficient values of 0.2 or less vs. a dry Ag surface.

In addition, the nanoplatelets of G induce hardening of the Ag which substantially increases wear resistance.

The graphene dispersion and alignment are accomplished via an electroplating route, in which an electrolyte of the plating bath, preferably aqueous, is designed in such a way that:

1. An Ag salt is easily dissolved in the plating electrolyte (without the presence of cyanide-based complexing agents).
2. Graphene is dissolved but in a meta-stable state, such that the zeta potential between flakes 3 and electrolyte is positive and between 10 and 30 mV, and such that electrophoresis of the flakes occurs when an electric negative potential is applied on the substrate surface 4.

An example of such a plating bath is the following:

| Component | Range |
|---|---|
| $AgNO_3$ (soluble Ag salt) | 0.3 mol/l (ca. 50 g/l) |
| 5,5-Dimethylhydantion (Ag complexing agent) | 1.2 mol/l (ca. 155 g/l) |
| Graphene | 0.1 g/l |
| CTAB (cationic surfactant to create positive zeta potential of the graphene-surfactant complex) | 1 mmol/l (ca. 0.35 g/l) |
| KOH (pH adjust to 11-12 to set zeta potential to values around 20 mV) | ca. 1 mmol/l (ca. 0.05 g/l) |

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. A method of electroplating of a silver-graphene composite onto a substrate, the method comprising:
- preparing a plating bath comprising:
  - a dissolved water soluble silver salt comprising silver ions,
  - a stable dispersion of graphene flakes, and
  - an aqueous electrolyte, the electrolyte comprising:
    - a silver complexing agent to inhibit spontaneous deposition of the silver ions on a surface of the substrate,
  - a cationic surfactant comprising cetyltrimethylammonium bromide (CTAB), and
  - a pH adjusting compound, wherein the pH of the plating bath is within the range of 10-13;
- adjusting a zeta potential across a graphene-electrolyte interface in the plating bath to be within the range of 10-30 mV based on the cationic surfactant and the pH adjusting compound to inhibit aggregation of the graphene flakes in the plating bath and to promote alignment of the graphene flakes with the surface of the substrate during electrophoresis; and
- applying a negative electric potential on a surface of the substrate such that electrophoresis of the graphene flakes occurs and said flakes are co-deposited with the silver ions during electroplating thereof to align the graphene flakes with the surface of the substrate to form a silver-graphene composite coating on the substrate surface with the graphene flakes dispersed in a silver matrix and substantially flat and aligned with the surface of the substrate.

2. The method of claim 1, wherein the pH adjusting compound comprises at least one of potassium hydroxide (KOH), and sodium hydroxide (NaOH).

3. The method of claim 1, wherein the cationic surfactant is present in the plating bath in a concentration within the range of 0.5-2 mmol/L.

4. The method of claim 1, wherein the zeta potential is adjusted to within the range of 15-25 mV.

5. The method of claim 1, wherein the silver salt comprises at least one of silver nitrate ($AgNO_3$) and silver oxide ($Ag_2O$).

6. The method of claim 5, wherein the silver salt is present in the plating bath in a concentration within the range of 0.1-0.5 mol/L.

7. The method of claim 1, wherein the silver complexing agent comprises 5,5-dimethylhydantion.

8. The method of claim 7, wherein the silver complexing agent is present in the plating bath in a concentration within the range of 0.5-2 mol/L.

9. The method of claim 1, wherein the silver-graphene composite has a graphene content within the range of 0.05-1% by weight of the composite.

10. The method of claim 1, wherein the graphene flakes have an average longest axis within the range of from 100 nm to 50 μm.

11. The method of claim 10, wherein the graphene flakes have between 50 and 150 graphene layers.

12. The method of claim 1, wherein the zeta potential is adjusted to be within a range of 18-22 mV.

13. The method of claim 1, wherein the zeta potential is adjusted to be within a range of 19-21 mV.

14. The method of claim 1, further comprising ultrasonicating the plating bath to promote separation between the graphene flakes in the plating bath before applying the negative electric potential.

15. The method of claim 1, wherein the graphene flakes have a lateral size of less than 1 μm to promote nucleation of the silver ions around the graphene flakes.

16. The method of claim 1,
- wherein the pH of the plating bath is within the range of 11-12.

17. A method of electroplating of a silver-graphene composite onto a substrate, the method comprising:
- preparing a plating bath comprising:
  - a dissolved water soluble silver salt comprising silver ions,
  - a stable dispersion of graphene flakes, and
  - an aqueous electrolyte, the electrolyte comprising:
    - a silver complexing agent to inhibit spontaneous deposition of the silver ions on a surface of the substrate, a cationic surfactant comprising polyethyleneimine (PEI), and a pH adjusting compound, wherein the pH of the plating bath is within the range of 7-9;

adjusting a zeta potential across a graphene-electrolyte interface in the plating bath to be within the range of 10-30 mV based on the cationic surfactant and the pH adjusting compound to inhibit aggregation of the graphene flakes in the plating bath and to promote alignment of the graphene flakes with the surface of the substrate during electrophoresis; and applying a negative electric potential on a surface of the substrate such that electrophoresis of the graphene flakes occurs and said flakes are co-deposited with the silver ions during electroplating thereof to align the graphene flakes with the surface of the substrate to form a silver-graphene composite coating on the substrate surface with the graphene flakes dispersed in a silver matrix and substantially flat and aligned with the surface of the substrate.

18. The method of claim 16, wherein the pH of the plating bath is within the range of 7-8.

* * * * *